US007766758B2

(12) United States Patent
Clark

(10) Patent No.: US 7,766,758 B2
(45) Date of Patent: Aug. 3, 2010

(54) GOLF TRAINING DEVICE

(76) Inventor: Stephen W. Clark, 919 Sawgrass St., Clewiston, FL (US) 33440-0209

( * ) Notice: Subject to any disclaimer, the term of this patent is extended or adjusted under 35 U.S.C. 154(b) by 0 days.

(21) Appl. No.: 11/858,557

(22) Filed: Sep. 20, 2007

(65) Prior Publication Data

US 2009/0082121 A1 Mar. 26, 2009

(51) Int. Cl.
*A63B 69/36* (2006.01)

(52) U.S. Cl. ..... 473/218; 473/265; 473/272

(58) Field of Classification Search ..... 473/218, 473/265, 266, 268, 269, 270, 272, 273
See application file for complete search history.

(56) References Cited

U.S. PATENT DOCUMENTS

| | | | | |
|---|---|---|---|---|
| 3,868,116 | A * | 2/1975 | Ford et al. | 473/218 |
| 4,101,130 | A | 7/1978 | Richards | |
| 4,257,608 | A * | 3/1981 | Funk | 473/272 |
| 4,736,952 | A | 4/1988 | Taft et al. | |
| 4,871,175 | A | 10/1989 | Levin et al. | |
| 4,915,387 | A | 4/1990 | Baxstrom | |
| 4,962,933 | A | 10/1990 | Awazu et al. | |
| 5,116,058 | A * | 5/1992 | Theriault | 473/268 |
| 5,139,263 | A * | 8/1992 | Feo | 473/218 |
| 5,171,017 | A | 12/1992 | Betancourt | |
| 5,246,234 | A * | 9/1993 | Zambelli | 473/272 |
| 5,350,177 | A * | 9/1994 | Furbush, Jr. | 473/218 |
| 5,527,037 | A | 6/1996 | Matsumoto | |
| 6,077,169 | A | 6/2000 | Florian | |
| 6,500,075 | B1 | 12/2002 | McDevitt | |
| 7,112,144 | B2 | 9/2006 | Mindlin | |
| 2001/0003104 | A1 | 6/2001 | Binduga | |
| 2004/0137999 | A1 | 7/2004 | Park | |
| 2006/0128493 | A1 | 6/2006 | Snopkowski | |

* cited by examiner

*Primary Examiner*—Nini Legesse
(74) *Attorney, Agent, or Firm*—Fox Rothschild, LLP; Robert J. Sacco

(57) ABSTRACT

A golf training device (100) includes first and second positioning members (110, 120) movably attached to a planar base portion (101). The first and second positioning members (110, 120) are movable from a stowed configuration to a pitch and chip shot setup configuration. The first and second positioning members (110, 120) include one or more indicia (114, 124) for positioning one or more golf balls (20) when moved to the shot setup configuration. The first and second positioning members (110, 120) position the one or more golf balls (20) a predetermined distance from an edge (103) of the device (100). The first positioning member (110) positions one or more golf balls (20) a first predetermined distance (D1) from the device (100) corresponding to a pitch shot. The second positioning member (120) positions one or more golf balls (20) a second predetermined distance (D2) from the device (100) corresponding to a chip shot.

22 Claims, 8 Drawing Sheets

GOLF TRAINING DEVICE

BACKGROUND OF THE INVENTION

1. Statement of the Technical Field

The invention relates to training devices. More particularly, this invention relates to a golf training device and related method for the setup of practice pitch and chip shots in the game of golf.

2. Background of the Invention

In the game of golf, the goal is to get the golf ball from the teeing ground to each of eighteen holes of a golf course. It is preferred that this result be accomplished with the least number of shots possible, using any of fourteen different available clubs. Each of the eighteen holes is spread out in succession with each hole located on a portion of the golf course known as the putting green. The goal is to get the ball from the teeing ground into the hole on the putting green in the lowest number of shots possible. Each hole is classified by its par. Par is the number of strokes that a skilled golfer should require to complete the hole. After the ball is hit into all of the holes, the score is added up from each hole to calculate a total score. The lower the score, the better the game.

Typically, at least the first stroke on each hole is hit from the teeing ground with a club such as a driver. Most driver clubs are considered wood clubs because they have traditionally been made of wood. The goal is to hit the golf ball with a driver so that the golf ball will travel a long distance down the fairway toward the putting green. Usually, the golf ball will come to rest in the fairway or in the rough. Playing the ball from the fairway is an advantage because the fairway grass is kept very short and even, allowing the player to cleanly strike the ball, while playing from the rough is a disadvantage because the grass in the rough is generally much longer, which may affect the flight of the ball.

Many holes includes hazards such as water hazards such as lakes or rivers, man-made hazards such as bunkers or sand traps, and lateral hazards such as dense vegetation areas, bush lands, or gardens. Thus, a golfer is faced with a choice on how to hit the golf ball toward the putting green in view of the remaining distance to the putting green and any of the aforementioned hazards that may lie in between. If the distance remaining to the putting green is large, for example, 175 yards or more, a golfer may still wish to use a club such as driver to get the golf ball closer to the putting green. If the golf ball is closer than 175 yards to the putting green, a golfer may choose to use a club such as an iron. Still, additional golf strokes may be required to get the golf ball onto the putting green.

Once the golf ball is driven to within 80 yards of the hole, the remaining distance to the putting green is where most of the skill is required in the game of golf. This portion of the golf game is known as the "short game." Most golf shots played in the "short game" are either pitch shots or chip shots. A pitch shot is selected when it is desired to drive the ball with a high trajectory and little roll once the ball has landed on the putting green. In contrast, a chip shot is selected when it is desired to drive the golf ball with the golf ball having a lower trajectory and a longer roll. The point is to get the golf ball on the surface of the putting green and let it roll toward the hole. Still, the selection of the pitch or chip shot depends on such factors as the conditions at the golf course such as wind and weather, the remaining distance of the ball on the putting green to the hole, and any hazards that may lie in between.

It is known in the art to use a device for improving a user's golf game. More particularly, such prior art devices are for training a user's golf swing and for practicing various shots in golf. For example, in U.S. Pat. No. 4,101,130 there is a pliable mat for use by golfers for improving their stance and swing. The mat has a generally rectangular shape and is provided with cut-out portions delineating the position of the right and left feet of the golfer. The mat has appropriately located indicia of length and golf club types for correctly locating the golf ball in position and distance from the golfer as a function of the club being used.

Another example can be found in U.S. Pat. No. 4,738,862 where there is a golf training and practice device for improving the user's golf stance, swing alignment, club face position, club take-away, down swing governor, body turn and putt training for left or right handed golfers. The device allows the user to practice the golf swing for all golf clubs from a putter to a driver.

However, the prior art including the foregoing examples does not include devices directed specifically towards improving the golf swing for the pitch and chip shots typically played in the short game. In view of the forgoing, there remains a need for a device directed specifically towards improving the golf swing for the pitch and chip shots for improving the overall golf score.

SUMMARY OF THE INVENTION

The invention concerns a golf training device for setting up practice pitch and chip shots typically played in the portion of the game of golf known as the short game. In one embodiment of the invention, the device includes a planar base portion including an edge defining an axis. There is at least one positioning member movable from a stowed position to a shot setup position. The positioning member includes one or more indicia configured for positioning one or more golf balls adjacent to the positioning member a predetermined distance from the axis when moved to the shot setup position. The one or more indicia are equally spaced along an edge of the positioning member. In one embodiment of the invention, the one or more indicia are six indicia and said one or more golf balls are six golf balls. There is at least one channel defined on the base portion configured for stowing the positioning member while a golfer positioned relative to the axis strikes the one or more golf balls with a golf club.

The shot setup position includes pitch and chip shot setup positions. The positioning member includes a first positioning member and a second positioning member. The positioning member includes a first positioning member and the predetermined distance includes a first predetermined distance corresponding to a pitch shot. The positioning member includes a second positioning member and the predetermined distance includes a second predetermined distance corresponding to a chip shot. The positioning member is u-shaped. The free ends of the positioning member are movably attached to the first planar portion by pins.

The device includes a first planar portion and a second planar portion defining an upper surface of the device. The axis, predetermined distance, and upper surface define a visual guide for the backswing and downswing of the golf club for defining an angle of approach of the golf club for the desired shot while the golfer strikes the one or more golf balls.

In another embodiment of the invention, there is a golf training device for setting up one or more golf balls for practicing golf shots typically played in the short game in golf. The device includes a planar base portion including an edge defining an axis and at least a first positioning member movable from a stowed position to a first shot setup position. The first positioning member includes one or more indicia configured for positioning one or more golf balls adjacent to the first positioning member a first predetermined distance from the axis when moved to the first shot setup position. There is at least a second positioning member movable from a stowed position to a second shot setup position. The second positioning member includes one or more indicia configured for positioning one or more golf balls adjacent to the second positioning member a second predetermined distance when moved to the second shot setup position. The one or more indicia are equally spaced along an edge of the first and second positioning members. In one embodiment of the invention, the one or more indicia are six indicia and said one or more golf balls are six golf balls. There is a channel defined on the base portion for each of the first and second positioning members configured for stowing the first and second positioning members while a golfer positioned relative to the axis strikes the one or more golf balls.

The first shot setup position includes a pitch shot setup position. The second shot setup position includes a chip shot setup position. The first positioning member and the first predetermined distance correspond to a pitch shot. The second positioning member and the second predetermined distance correspond to a chip shot. The first and second positioning members are u-shaped. The free ends of the first and second positioning members are movably attached to the first planar portion by pins.

The device further includes a first planar portion and a second planar portion defining an upper surface of the device. The axis, first predetermined distance, and upper surface define a guide for the backswing and downswing of the golf club for defining an angle of approach of the golf club for a pitch shot while the golfer strikes the one or more golf balls. The axis, second predetermined distance, and upper surface define a visual guide for the backswing and downswing of the golf club defining an angle of approach of the golf club for a chip shot while the golfer strikes the one or more golf balls.

In another embodiment of the invention, there is a related method for practicing golf shots and for guiding a movement of a golf club during a golf swing. The method includes the steps of positioning a golf training device in a set position. The method includes the step of moving a positioning member of the golf training device from a stowed position to a shot setup position. The method includes the step of using the positioning member to position a golf ball at a predetermined distance from the golf training device. The method includes the step of returning the positioning member to the stowed position. The method includes the step of after the returning step, with the golf training device remaining in the set position, performing at least one golf swing to hit the golf ball. The method includes the step of using the golf training device to limit an approach angle of a golf club head during the golf swing to a predetermined range of angles defined by a surface of the golf training device and the predetermined distance.

BRIEF DESCRIPTION OF THE DRAWINGS

Embodiments will be described with reference to the following drawing figures, in which like numerals represent like items throughout the figures, and in which.

DETAILED DESCRIPTION OF THE PREFERRED EMBODIMENTS

Figure 1:
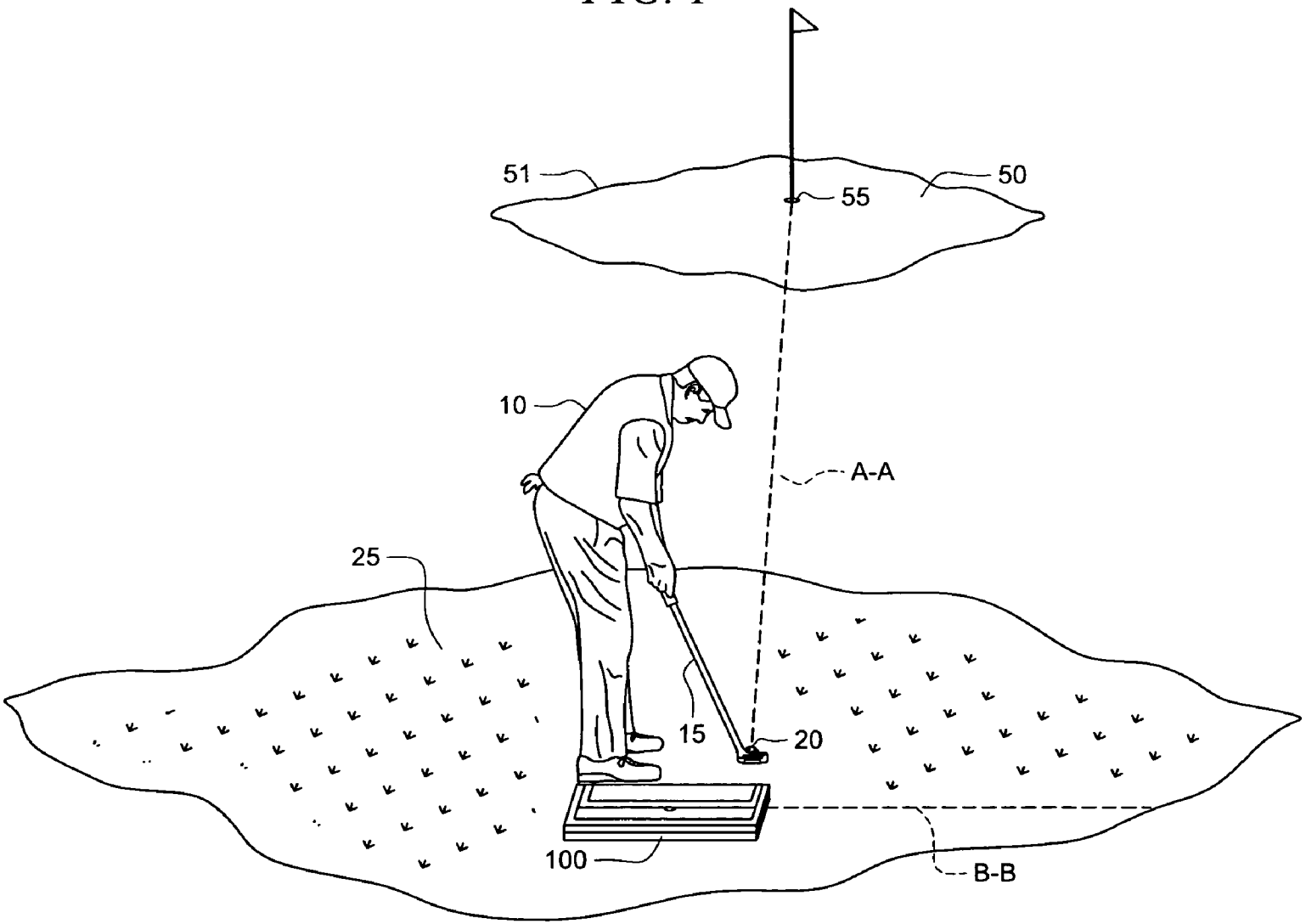
FIG. 1 is an elevated perspective view of the intended use of a golf training device for improving the golf swing in a pitch shot, that is useful for understanding the invention.

Referring now to FIG. 1, shown is a perspective view of the intended use of a golf training device 100 for practicing pitch or chip shots in the game of golf, according to an embodiment of the invention. In use, the device 100 is placed on a portion of a golf course 25 a desired distance from a putting green 50. The desired distance corresponds to the distance that one of the foregoing pitch or chip shots is typically played from in the portion of the golf game known as the "short game" as is known to one of ordinary skill in the art. The portion of the golf course 25 could be a portion of the fairway, rough, or a hazard such as a sand trap.

The putting green 50 includes a cup or hole 55 where the golfer 10 desires to sink a golf ball 20. The putting green 50 is defined by a peripheral edge 51. The device 100 has a first positioning member 110 (FIGS. 2-5) and a second positioning member 120 (FIGS. 2-5) that are used to position one or more golf balls 20 in a predetermined position relative to the device 100 to setup one or more golf balls for practicing a pitch or chip shot. The one or more golf balls 20 are positioned in the predetermined position relative to the device 100 to aid the golfer 20 in practicing the pitch or chip shot. The operation of the first and second positioning members 110, 120 (FIGS. 2-5) is described in full detail hereinbelow.

Prior to making the desired practice shot the golfer 10 positions him or herself relative to the device 100 and an axis B-B defined by the device 100. The golf ball 20 is now also positioned relative to the hole 55 along an axis A-A. In the embodiment of the invention shown in FIG. 1, a single golf ball 20 is shown in the pitch shot setup position. However, the device 100 can be used to setup one or more golf balls 20 for practicing either of the pitch or chip shots.

A pitch shot is typically played with a highly lofted club that is designed to go a short distance with a high trajectory. In a pitch shot the golf ball is in the air most of the distance to the putting green 50 and has little roll once it hits the ground. Alternately, a chip shot may be desired when the golf ball 20 is played much closer to the putting green 50. The goal is to keep the trajectory of the golf ball 20 low and the golf ball 20 in the air for only a short time.

However, as previously described, the decision to play a pitch shot or chip shot depends on factors such as conditions at the golf course such as wind or weather, the remaining distance of the ball on the putting green 50 to the hole 55, and any obstacles such as sand traps that may lie between the golf ball 20 to be played and the putting green 50. For example, if the distance remaining to the putting green 50 is relatively short, if typically would be desirable to select a chip shot to get the ball onto the putting green 50 and into the hole 55. However, if the golf ball 20 is being played from a sand trap, or there is an obstacle such as a sand trap that lies between the golf ball 20 and the putting green 50, it might be desirable to play the shot as a pitch shot. In this regard, it is desirable to give the golf ball 20 a higher trajectory to get the golf ball 20 out of the sand trap or over an obstacle such as a sand trap to drive the golf ball 20 to the putting green 50. Once the golf ball 20 is on the putting green 50, the golf ball 20 is typically played into the hole 55 with a putting stroke.

Figure 2:
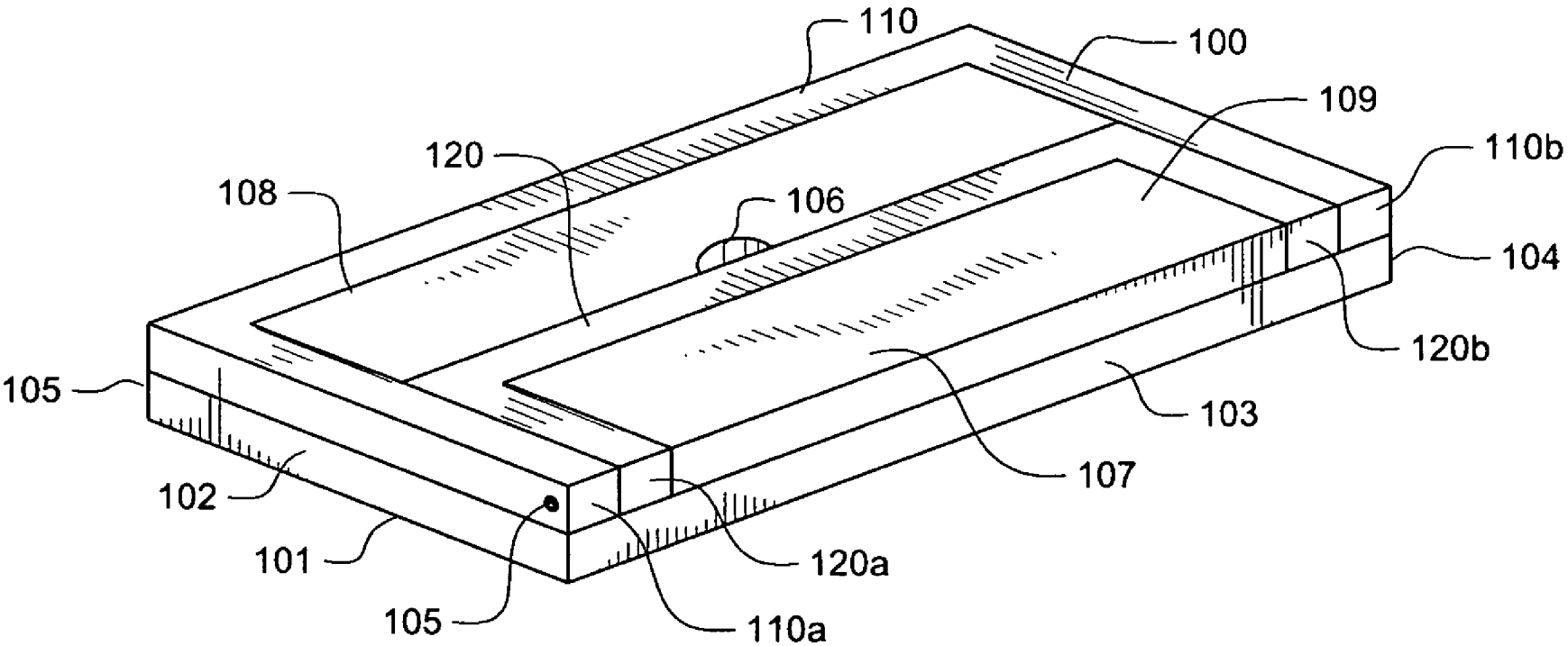
FIG. 2 is an elevated perspective view of the golf training device of FIG. 1.

Referring now to FIG. 2, shown is an elevated perspective view of a golf training device 100 comprised of a planar base portion 101, a u-shaped first positioning member 110, and a u-shaped second positioning member 120 wherein the first and second positioning members 110, 120 are in the stowed configuration or position. The planar base portion 101 could be formed from a suitable material including wood or plastic or other material known to one of ordinary skill in the art. Similarly, the first and second positioning members 110, 120 could be formed from a suitable material including wood or plastic or other material known to one of ordinary skill in the art.

The planar base portion 101 partially defines a first edge 102, second edge 103, third edge 104, and fourth edge 105 of the device 100. The training device 100 includes a first planar portion 107 disposed on the planar base portion 101. The training device 100 includes a second planar portion 108 disposed on the planar base portion 101. The first and second planar portions 107, 108 could be formed from materials such as wood or plastic or other material known to one of ordinary skill in the art.

The first positioning member 110 and second positioning member 120 are rotatably connected on their respective free ends 110*a*, 110*b* and 120*a*, 120*b* to the first planar portion by a pin 105 (only one can be seen in FIG. 2). When in the stowed configuration, the second positioning member 120 is disposed about the periphery of the first planar portion 107. When in the stowed configuration, the first positioning member 110 is disposed about the periphery of the second planar portion 108 and the second positioning member 120.

Figure 4:
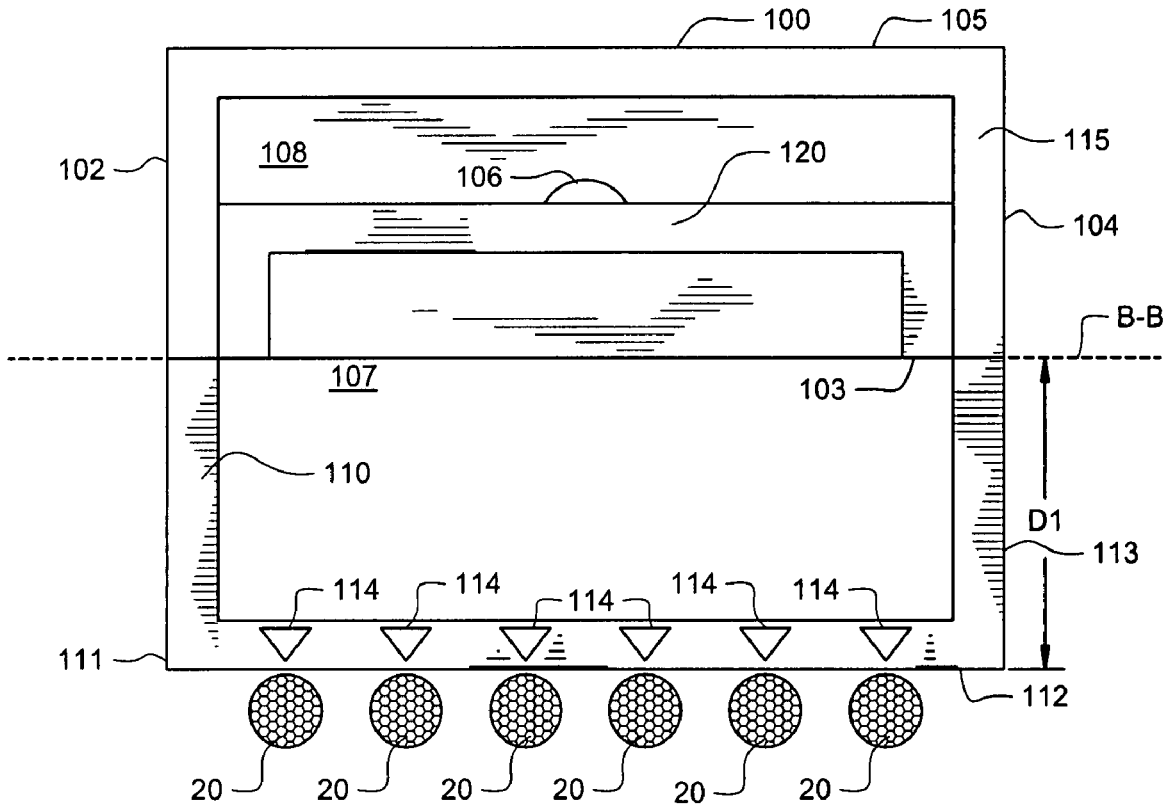
FIG. 4 is a top view of the golf training device of FIG. 2 with the first positioning member in the pitch shot setup configuration for positioning one more golf balls along one edge guided by one or more indicia disposed on the edge and the second positioning member in the stowed configuration.
Figure 5:
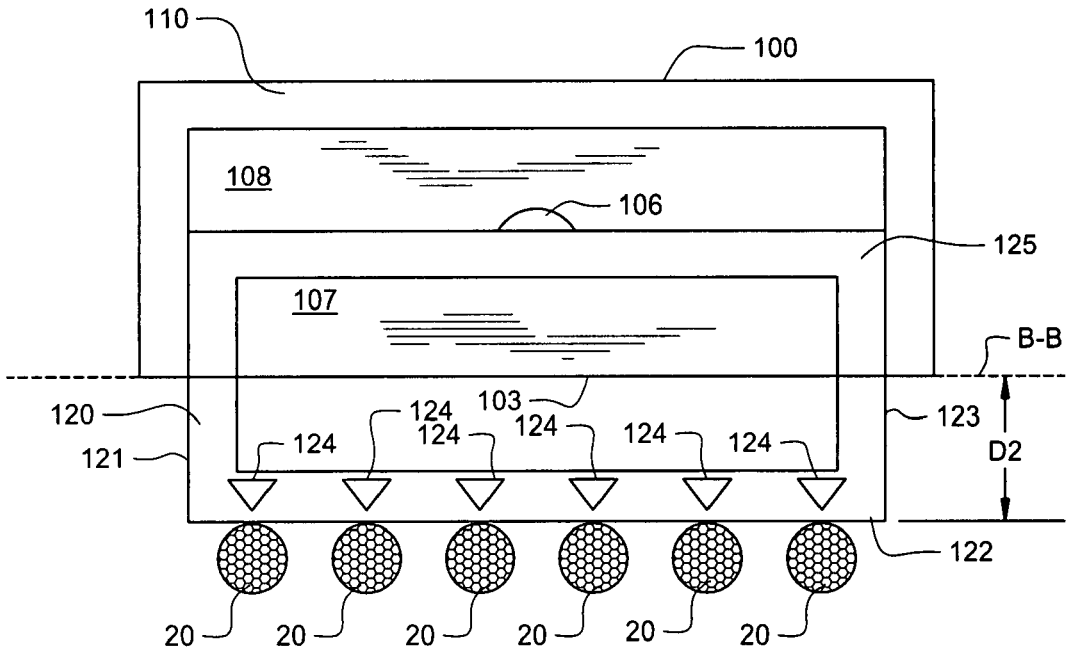
FIG. 5 is a top view of the golf training device of FIG. 2 with the second positioning member in the chip shot setup configuration for positioning one or more golf balls along one edge guided by one or more indicia disposed on the edge and the first positioning member in the stowed configuration.

There is a recess 108 defined in the second planar portion 108. The recess 106 is configured for allowing the second positioning member 120 to be grasped when it is desired to move the second positioning member 120 to the chip shot setup position (FIG. 5). Similarly, the first positioning member 110 can be grasped on its periphery when it is desired to move the first positioning member 110 to the pitch shot setup position (FIG. 4). Collectively, the first and second positioning members 110, 120 and the first and second planar portions 107, 108 define an upper surface 109 of the device 100.

In another embodiment of the invention, there could be a u-shaped third positioning member rotatably connected to the first planar portion 108 to setup another type of golf shot known to one of ordinary skill in the art. However, the invention is not limited in this regard. Instead, there could be any number of u-shaped positioning members rotatably connected to the first planar portion 108 for setting up various golf shots as is known to one of ordinary skill in the art.

Figure 3:
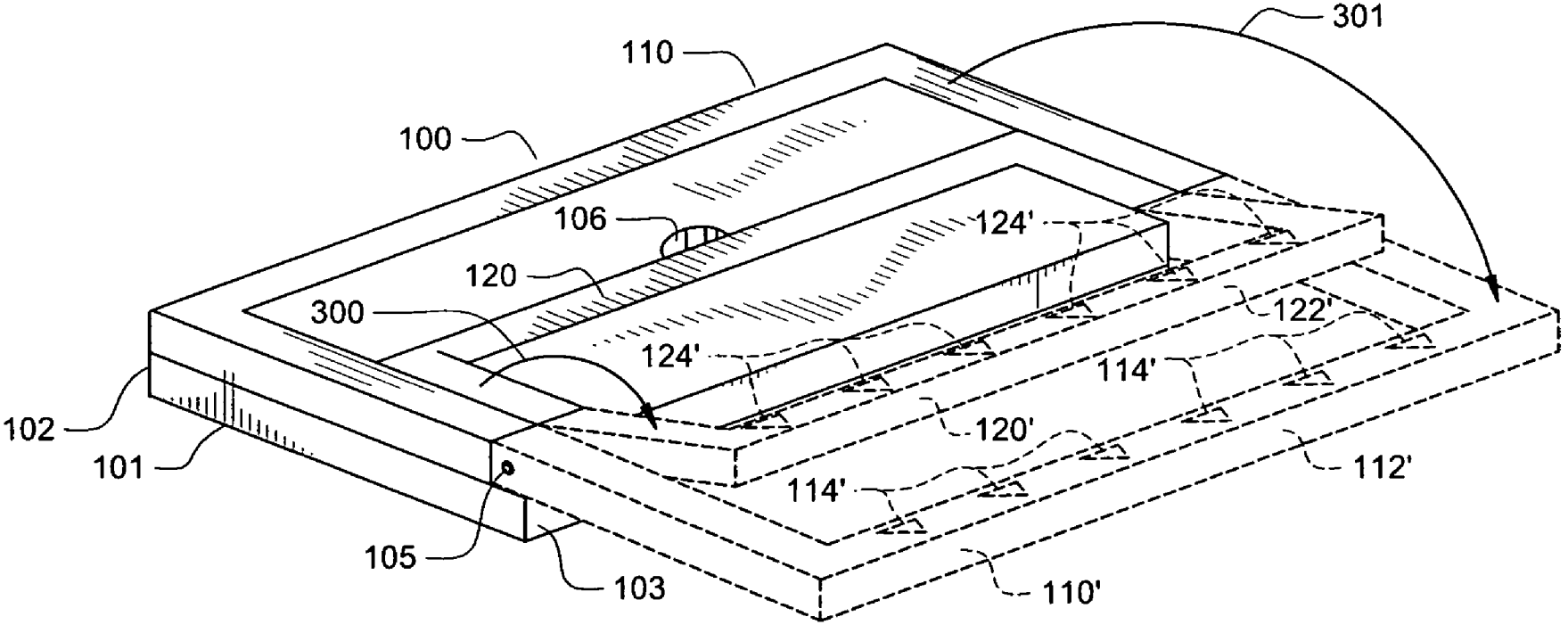
FIG. 3 is an elevated perspective view of the golf training device of FIG. 2 with first and second positioning members in a stowed configuration and the first and second positioning members also shown in phantom in an un-stowed configuration to illustrate their capability of being moved from the stowed configuration.

Referring now to FIG. 3, shown is an elevated perspective view of the golf training device of FIG. 2 with the first and second positioning members 110, 120 in a stowed configuration and the first and second positioning members 110', 120' also shown in phantom in an un-stowed configuration to illustrate their capability of being moved from the stowed configuration. The movement of the first positioning member 110 about pin 105 from the stowed configuration towards the pitch shot setup configuration is illustrated by the arrow 301. The movement of the second positioning member 120 about pin 105 from the stowed configuration towards the pitch shot setup configuration is illustrated by the arrow 300.

There is a plurality of positioning indicia 114' disposed along an edge 112' of the first positioning member 110'. The operation of the plurality of positioning indicia 114' is discussed in detail in FIG. 4. There is a plurality of positioning indicia 124' disposed along an edge 122' of the second positioning member 120'. The operation of the plurality of positioning indicia 124' is discussed in detail in FIG. 5.

In actual use, the first positioning member 110' shown in phantom would be moved so that the edge 112' would be touching the ground when setting up one or more golf balls 20 for a pitch shot. The second positioning member 120' shown in phantom would remain in the stowed configuration. Oppositely, the second positioning member 120' shown in phantom would be touching the ground when setting up one or more golf balls 20 for a chip shot. The first positioning member 110' shown in phantom would remain in the stowed configuration.

Referring now to FIG. 4, shown is a top view of the golf training device 100 with the first positioning guide 110 in the pitch shot setup configuration. One or more golf balls 20 can be positioned adjacent one edge 112 with the aid of a plurality equally spaced indicia 114 disposed on the edge 112. When positioned adjacent the edge 112 of the first positioning guide 110 in the pitch shot setup configuration, the one or more golf balls 20 are positioned a first predetermined distance D1 from second edge 103 of the device 100. The first predetermined distance D1 corresponds to a predetermined distance from an axis B-B used by the golfer 10 to position him or herself relative to the device 10 when performing a pitch shot (best seen in FIG. 8).

After returning the first positioning member 110 to the stowed configuration, the one or more golf balls 20 are precisely positioned so that the golfer 10 can perform several practice pitch shots according to the number of golf balls 20 positioned. In the embodiment shown in FIG. 4, the plurality of indicia 114 is six indicia and the corresponding number of golf balls 20 that can be positioned are also six. However, the invention is not limited in this regard as any number of indicia 114 and corresponding number of golf balls 20 can be positioned with the first positioning member 110.

Prior to the practice pitch shots being performed, the first positioning member 110 is returned to the stowed configuration in a channel 115 defined in the device 100. The channel 115 is a defined by the first planar portion 107, second positioning member 120 and second planar portion 108. When returned to the stowed configuration, the edge 112 of the first positioning member 110 aligns with the fourth edge 105 of the device 100. In addition, the first and second edges 111, 113 of the first positioning member 110 will align with respective first and third edges 102, 104 of the device 100.

Figure 4A:
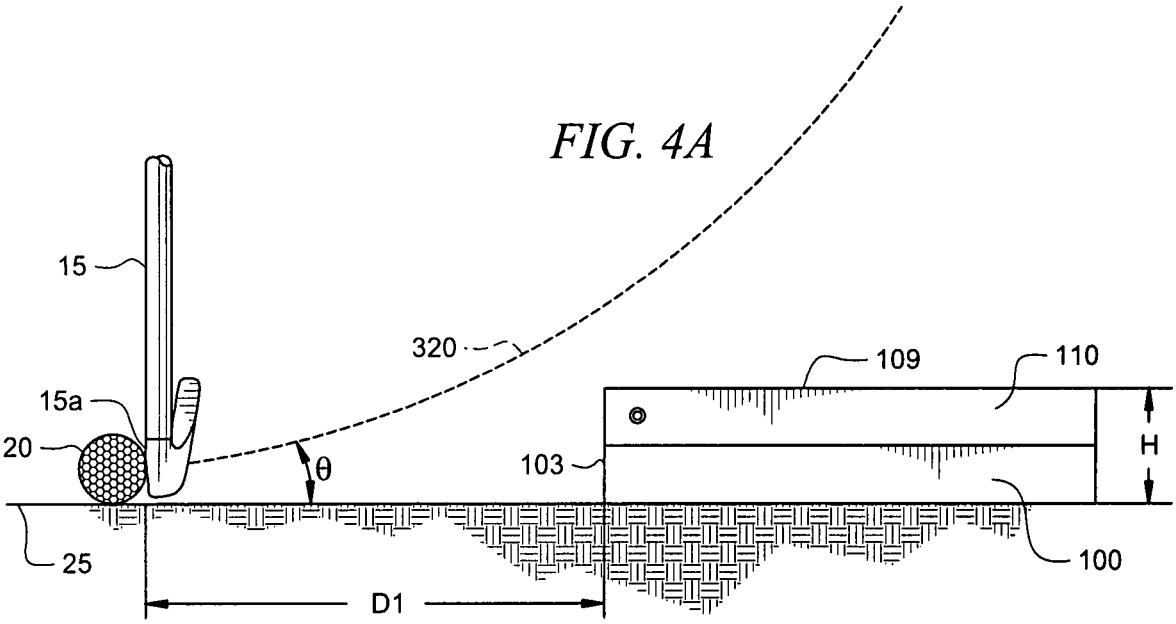
FIG. 4A is a side view of the golf training device of FIG. 2 with an exemplary golf ball positioned in the pitch shot setup position.

Referring now to FIG. 4A, shown is a side view of an exemplary golf ball 20 positioned in the pitch shot setup position relative to the device 100. The first positioning member 110 and second positioning member 120 (not shown) are in the stowed configuration. FIG. 4A demonstrates the operation of the training device 100 for aiding the golfer 10 in striking the ball 20 properly in a pitch shot. As previously discussed, when the golf ball 20 is positioned in the pitch shot setup position, the golf ball 20 is positioned a predetermined first distance D1 from second edge 103 of the device 100. Thus, in order for a golfer 10 to strike the golf ball 20, a golfer 10 must move the head 15*a* of the golf club 15 along an arc 320 during the backswing. The golfer 10 uses the upper surface 100 of the device 100 as a visual cue for aiding in the formation of the backswing. In addition, the golfer 10 uses the upper surface 109 of the device 100 as a visual cue to aid the golfer 10 in moving the head 15*a* of the golf club 15 along the arc 320 during the downswing in order to strike the golf ball 20 properly for a pitch shot.

In view of the foregoing, the first predetermined distance D1 and height H of the device 100 partially define the arc 320 that the golfer 10 moves the head 15*a* of the golf club 15 along during the golf swing to strike the golf ball 20. The arc 320 allows the golfer 10 to practice the necessary golf swing to properly strike the golf ball 20 for the pitch shot. In this regard, the arc 320 further defines an angle of approach θ that the head 15*a* of the golf club 15 strikes the golf ball 20 for a proper pitch shot. The angle of approach θ is the angle from which the head 15*a* of the golf club 15 strikes the golf ball 20 relative to the ground 25. The angle of approach θ is illustrated in FIG. 4A as the angle θ between the ground 25 and the arc 320. If should be appreciated that the angle of approach θ is limited to a predetermined range of angles defined partially by the height H of the device 100 and the distance D1 of the golf ball 20 from the second edge 103 of the device 100.

In the embodiment shown in FIG. 4A, the angle of approach θ has been selected to correspond to a distance D1 and height H that have been found conducive for making a proper pitch shot. The angle of approach θ for a pitch shot is less steep than the angle of approach ϕ (FIG. 5A) for the chip shot giving the a lower trajectory and more roll once the ball hits the ground.

Referring now to FIG. 5, shown is a top view of the golf training device 100 with the second positioning member 120 in the chip shot setup configuration. There are one or more golf balls 20 that can be positioned adjacent one edge 122 with the aid of a plurality of equally spaced indicia 124 disposed adjacent the edge 122. When positioned adjacent the edge 122 of the second positioning guide 120 in the chip shot setup configuration, the one or more golf balls 20 are positioned a second distance D2 from the second edge 103 of the device 100. The second distance D2 corresponds to a predetermined distance from an axis B-B used by the golfer 10 to position him or herself relative to the device 100 when performing a chip shot (best seen in FIG. 7).

After returning the second positioning member 120 to the stowed configuration, the one or more golf balls 20 are precisely positioned so that the golfer 10 can perform several practice chip shots according to the number of golf balls 20 positioned. In the embodiment shown in FIG. 5, the plurality of indicia 124 is six indicia and the corresponding number of golf balls 20 that can be positioned are also six. However, the invention is not limited in this regard as any number of Indicia 124 and corresponding number of golf balls 20 can be positioned with the second positioning member 120.

Prior to the practice chip shots being performed, the second positioning member 120 is returned to the stowed configuration in a channel 125 defined in the device 100. The channel 125 is a defined by the first planar portion 107, first positioning member 110 and second planar portion 108. When returned to the stowed configuration, the edge 122 of the second positioning member 120 is disposed adjacent the second planar portion 108. In addition, the first and second edges 121, 123 of the second positioning member 120 align with internal edges of the first positioning member 110.

Figure 5A:
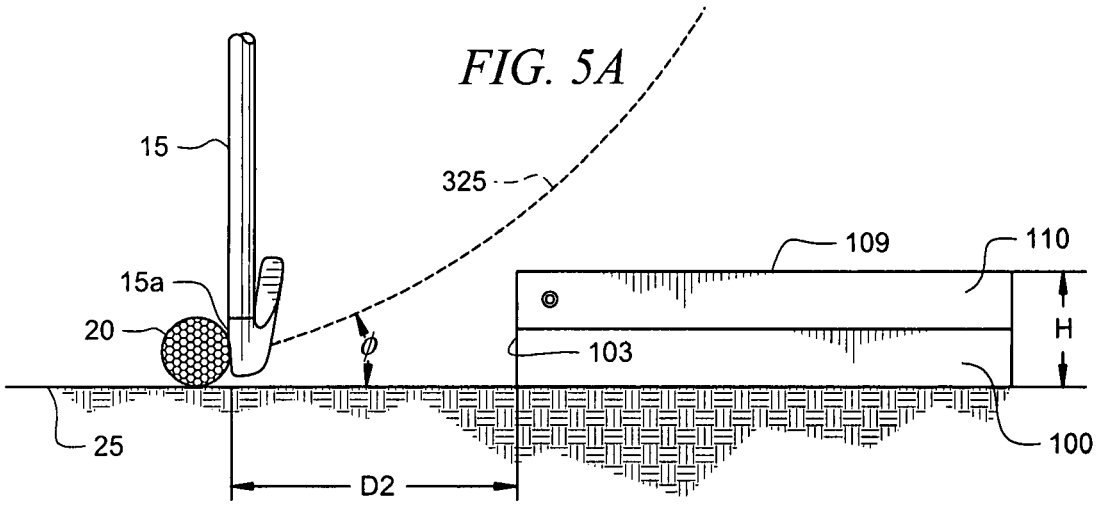
FIG. 5A is a side view of the golf training device of FIG. 2 with an exemplary golf ball positioned in the chip shot setup position.

Referring now to FIG. 5A, shown is a side view of an exemplary golf ball 20 positioned in the chip shot setup position relative to the device 100. The first positioning member 110 and second positioning member 120 (not shown) are in the stowed configuration. FIG. 5A demonstrates the operation of the training device 100 for aiding the golfer 10 in striking the ball 20 in a chip shot. As previously discussed, when the golf ball 20 is positioned in the chip shot setup position, the golf ball 20 is positioned a predetermined first distance D2 from second edge 103 of the device 100. Thus, in order for a golfer 10 to strike the golf ball 20, a golfer 10 must move the bead 15*a* of the golf club 15 along an arc 325 during the backswing. The golfer 10 uses the upper surface 109 of the device 100 as a visual cue for aiding in the formation of the backswing. In addition, the golfer 10 uses the upper surface 109 of the device 100 as a visual cue to aid the golfer 10 in moving the head 15*a* of the golf club 15 along the arc 325 during the downswing in order to strike the golf ball 20 properly for a chip shot.

In view of the foregoing, the distance D2 and height H of the device partially define the arc 325 that the golfer 10 must move the head 15*a* of the golf club 15 along during the golf swing to strike the golf ball 20. The arc 325 allows the golfer 10 to practice the necessary golf swing to properly strike the golf ball 20 for the chip shot. In this regard, the arc 325 further defines an angle of approach ϕ that the head 15*a* of the golf club 15 strikes the golf ball 20 during the chip shot. The angle of approach ϕ is the angle from which the head 15*a* of the golf club 15 strikes the golf ball 20 relative to the ground 25. The angle of approach ϕ is illustrated in FIG. 5A as the angle ϕ between the ground 25 and the arc 325. It should be appreciated that the angle of approach ϕ is limited by a predetermined range of angles partially defined by the height H of the device 100 and the distance D1 of the golf ball 20 from the second edge 103 of the device 100.

In the embodiment shown in FIG. 5A, the angle of approach ϕ has been selected to correspond to a distance D2 and height H that have been found conducive for making a proper chip shot. The angle of approach ϕ for the chip shot is steeper than the angle of approach θ (FIG. 4A) for a pitch shot causing the ball 20 to be driven at a higher trajectory with much less roil once the ball 20 hits the ground.

Figure 6:
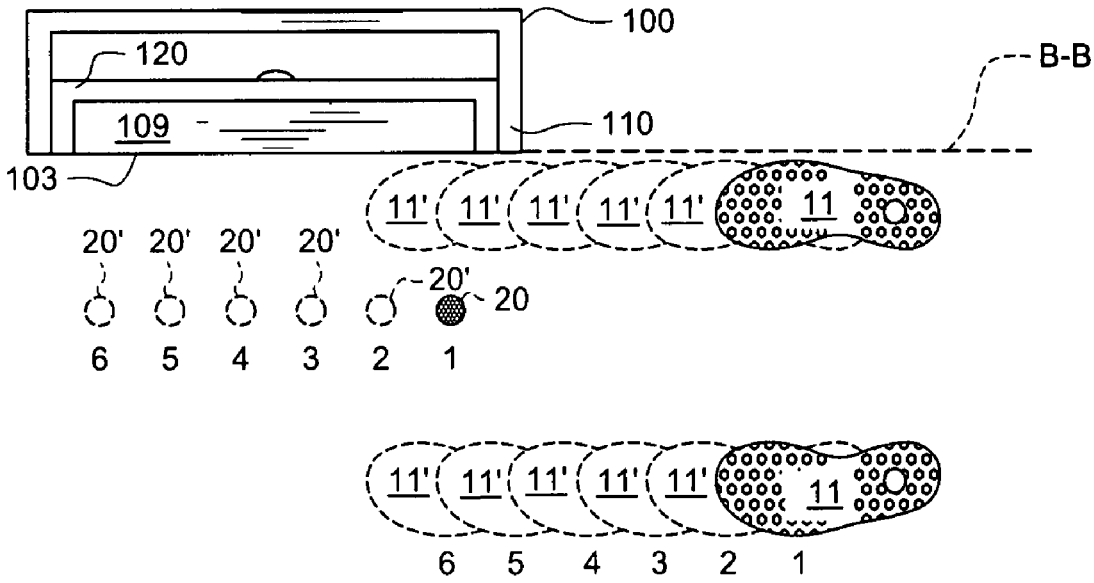
FIG. 6 is a top view of the device of FIG. 2 with the first and second positioning members in the stowed configuration showing the relative positioning of one or more golf balls positioned for a pitch shot and the feet placement of a golfer relative to an axis defined by the device for practicing the pitch shot with the corresponding one or more golf balls.

Referring now particularly to FIG. 6 and to FIG. 1, shown is a top view of the device 100 with the first and second positioning guides 110, 120 in the stowed configuration. FIG. 6 also shows the relative positioning of golf balls 20 and 20' and feet 11 and 11' corresponding to the position of a golfer's feet when practicing a pitch shot. FIG. 6 illustrates how the golfer 10 is positioned relative to the golf balls 20 and 20' and the axis B-B defined by the second edge 103 of the device 100. It should be appreciated that the golf balls 20 and 20' are positioned offset the middle of the golfer's stance in the pitch shot setup position. The golf balls 20 and 20' are numbered according to positions 1-6 and the corresponding feet 11 and 11' are represented by an outline of a pair of footprints numbered in positions 1-6. For the purposes of illustration, a single golf ball 20 in position 6 and the corresponding feet 11 in position 1 are shown in solid lines. The remaining golf balls 20' in positions 2-6 and the corresponding feet 11' in positions 2-6 are shown in phantom.

In order to describe the operation of the device 100 in practicing a pitch shot, it is necessary to describe the differences in the motion of the golf club 15 when making a pitch shot and a chip shot. The chip shot requires a steeper angle while the pitch shot requires the club to move back at a loss steep angle. The pitch shot also requires the golfer to use the wrist. As the golf ball 20 is struck, the golfer 10 wants to drop the golf club under the golf ball 20. As the golfer follows through the swing, position should be maintained as much as possible without turning the club. The golfer 10 should also ensure that the golfer 10 accelerates through the swing.

In either ease, the proper execution of both the chip and pitch shots requires striking the golf ball 20 with the golf club 15 property. A golf hall 20 is struck properly with a golf stroke known as a descending blow. In a descending blow, the golf ball 20 is struck with the golf club 15 before hitting the ground with the golf club 15. A descending blow also requires a proper angle of approach. An improperly executed golf stroke known as an ascending blow occurs when lift is unintentionally added to the golf ball 20 from the golf swing because of improper contact with the golf ball 20. In other words, any lift intended to be added to the golf ball 20 should be from the loft of the particular golf club 15 selected for the shot rather than from the improper contact with the golf ball 20. Thus, in both the pitch and chip strokes, it is desirable to hit the golf ball 20 with the proper angle of approach with the head of the golf club 15.

In view of the foregoing, it is desirable in a pitch shot to position a golf ball 20 a predetermined distance D1 (FIGS. 4 and 4A) from the axis B-B defined by the second edge 103 of the device 100. This is in contrast to the shorter predetermined distance D2 (FIGS. 5 and 5A) from the axis B-B defined by the second edge 103 of the device 100 desirable for a chip shot. The longer predetermined distance D1 (FIGS. 4 and 4A) corresponding to a pitch shot allows for hitting the golf ball 20 at a less steep angle.

If the second edge 103 defining axis B-B of the device 100 is used as a guide for the backswing and the downswing of the golf swing in the pitch shot, the distance D1 (FIGS. 4 and 4A) and the second edge 103 defining axis B-B partially define a predetermined angle of approach θ (FIG. 4A) of the head of the golf club 15 to the golf ball 20 conducive to a proper pitch shot. In other words, if the golfer 10 takes care during the backswing and the downswing of the golf swing uses the upper surface 109 of the device 100 as a visual cue, the head of the golf club 15 will have an angle of approach θ (FIG. 4A) conducive to making proper contact with the golf ball 20 for a pitch shot.

Thus, the longer first distance D1 (FIGS. 4 and 4A) is more conducive to a proper pitch shot which requires a less steep angle of approach θ (FIG. 4A) of the golf club 15 as compared to a chip shot which requires a steeper angle of approach. The shorter horizontal motion corresponds to the shorter second distance D2 (FIGS. 5 and 5A) the second positioning member 120 positions the one or more golf bells 20 from the axis B-B defined by the second edge 103 of the device 100.

Similarly, if the upper surface 109 of the device 100 is used as a visual cue for the formation of the backswing and the downswing of the golf stroke in the chip shot, the second distance D2 (FIGS. 5 and 5A) and the second edge 103 partially define a predetermined angle of approach ϕ (FIG. 5A) of the head 15*a* of the golf club 15 to the golf ball 20 conducive to a chip shot. In other words, if during the backswing and the downswing of the golf swing the golfer 10 uses the upper surface 109 of the device 100 as a visual cue, the head 15*a* of the golf club 15 will have an angle of approach ϕ (FIG. 5A) conducive to making proper contact with the golf ball 20 for a chip shot.

In use, the golfer 10 will position their feet such as in position 1 to practice a pitch stroke using a corresponding golf ball 20 in position 1 as shown in FIG. 6. The feet 11 in position 1 correspond to the position the golfer 10 will stand prior to making the pitch shot relative to the device 100 and the axis B-B defined by the second edge 103 of the device 100 and the golf ball 20 in position 1. The exact position of the feet 11 in position 1 will depend on such factors as the first distance D1 (FIGS. 4 and 4A), the height and stance of the golfer 10, and the length of the golf club 15. Once the golfer 10 is in position, the golfer 10 uses the upper surface 109 of the device 100 as visual cue for forming the backswing and following through with the downswing to strike the golf ball 20 with the proper angle of approach θ (FIG. 4A) for the pitch shot.

The golfer 10 can also make additional practice pitch shots in succession by repositioning in the next adjacent feet 11' position and striking the corresponding golf ball 20' in the corresponding position. For example, the golfer 10 can reposition their feet 11' in position 2 to strike the golf ball 20' in the corresponding position 2. The additional practice pitch shots can be made until all of the golf balls 20' in positions 2 to 6 are struck by the golfer 10 repositioning themselves in the corresponding feet 11' positions 2 to 6. As the golfer 10 repositions to strike each successive golf ball 20 and 20' from position 2 to position 6, the corresponding position of the golfer 10 as represented by the feet 11 and 11' in the corresponding positions 6 to 1 moves closer to the device 100 parallel to the axis B-B.

Figure 7:
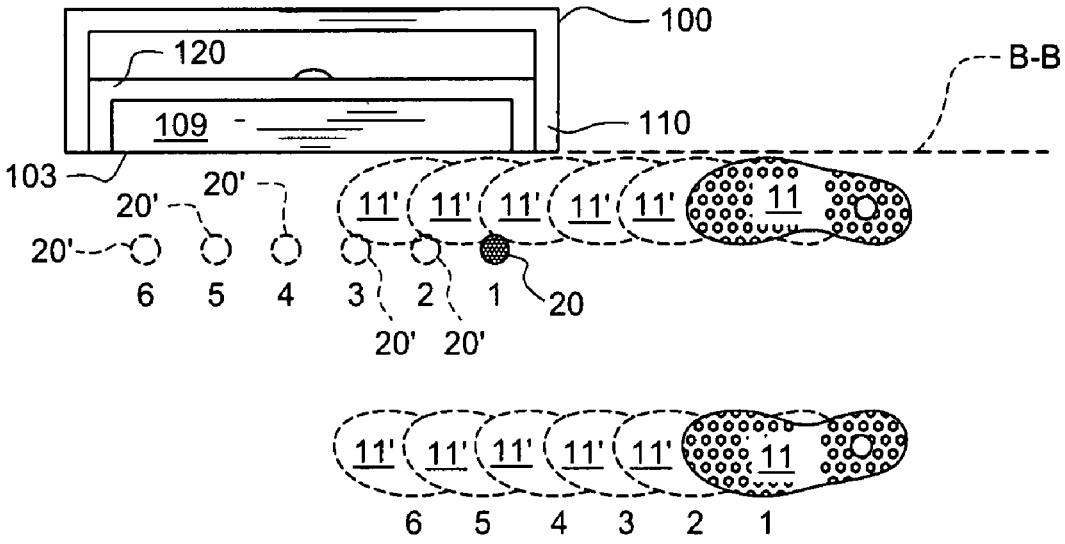
FIG. 7 is a top view of the device of FIG. 2 with the first and second positioning guides in the stowed configuration showing the relative positioning of one or more golf balls positioned for a chip shot and the feet placement of a golfer relative to an axis defined by the device for practicing the chip shot with the corresponding one or more golf balls.

Referring now particularly to FIG. 7 and to FIG. 1, shown is a top view of the device 100 with the first and second positioning members 110, 120 in the stowed configuration. FIG. 7 also shows the relative positioning of one or more golf balls 20 and 20' and corresponding feet positions 11 and 11' for practicing one or more chip shots. FIG. 7 illustrates the positioning of the golfer 10 relative to golf balls 20 and 20' and an axis B-B defined by the second edge 103 of the device 100. It should be appreciated that the golf balls 20 and 20' are positioned near the back of the golfer's stance in the chip shot setup position. The golf balls 20 and 20' are numbered according to positions 1-6 and the corresponding feet 11 and 11' are represented by an outline of a pair of footprints numbered in positions 1-6. For the purposes of illustration, a single golf ball 20 in position 1 and the corresponding feet 11 in position 1 are shown in solid lines. The remaining golf balls 20' in positions 2-6 and the corresponding feet 11' in positions 2-6 are shown in phantom.

In use, the golfer 10 will position their feet such as in position 1 to practice a chip stroke using a corresponding golf ball 20 in position 6 as shown in FIG. 7. The feet 11 in position 1 correspond to the position the golfer 10 will stand prior to making the chip shot relative to the device 100 and the axis B-B defined by the second edge 103 of the device 100 and the golf ball 20 in position 1.

The exact position of the feet 11 in position 1 will depend on such factors as the second distance D2 (FIG. 5), the height and stance of the golfer 10, and the length of the golf club 15. Once the golfer 10 is in position, the golfer 10 uses the upper surface 109 of the device 100 as a visual cue for forming the backswing and following through with the downswing to strike the golf ball 20 to with an angle of approach ϕ conducive to making a proper chip shot.

The golfer 10 can also make additional practice chip shots in succession by repositioning in the next adjacent feet 11' position and striking the corresponding golf ball 20' in the corresponding position. For example, the golfer 10 can reposition their feet 11' in position 2 to strike the golf ball 20' in the corresponding position 2. The additional practice chip shots can be made until all of the golf balls 20' in positions 2 to 6 are struck by the golfer 10 repositioning themselves in the corresponding feet 11' positions 2 to 6. As the golfer 10 repositions to strike each successive golf ball 20 and 20' from position 2 to position 6, the corresponding position of the golfer 10 as represented by the feet 11 and 11' in the corresponding positions 2 to 8 moves closer to the device 100 parallel to the axis B-B.

Figure 8:
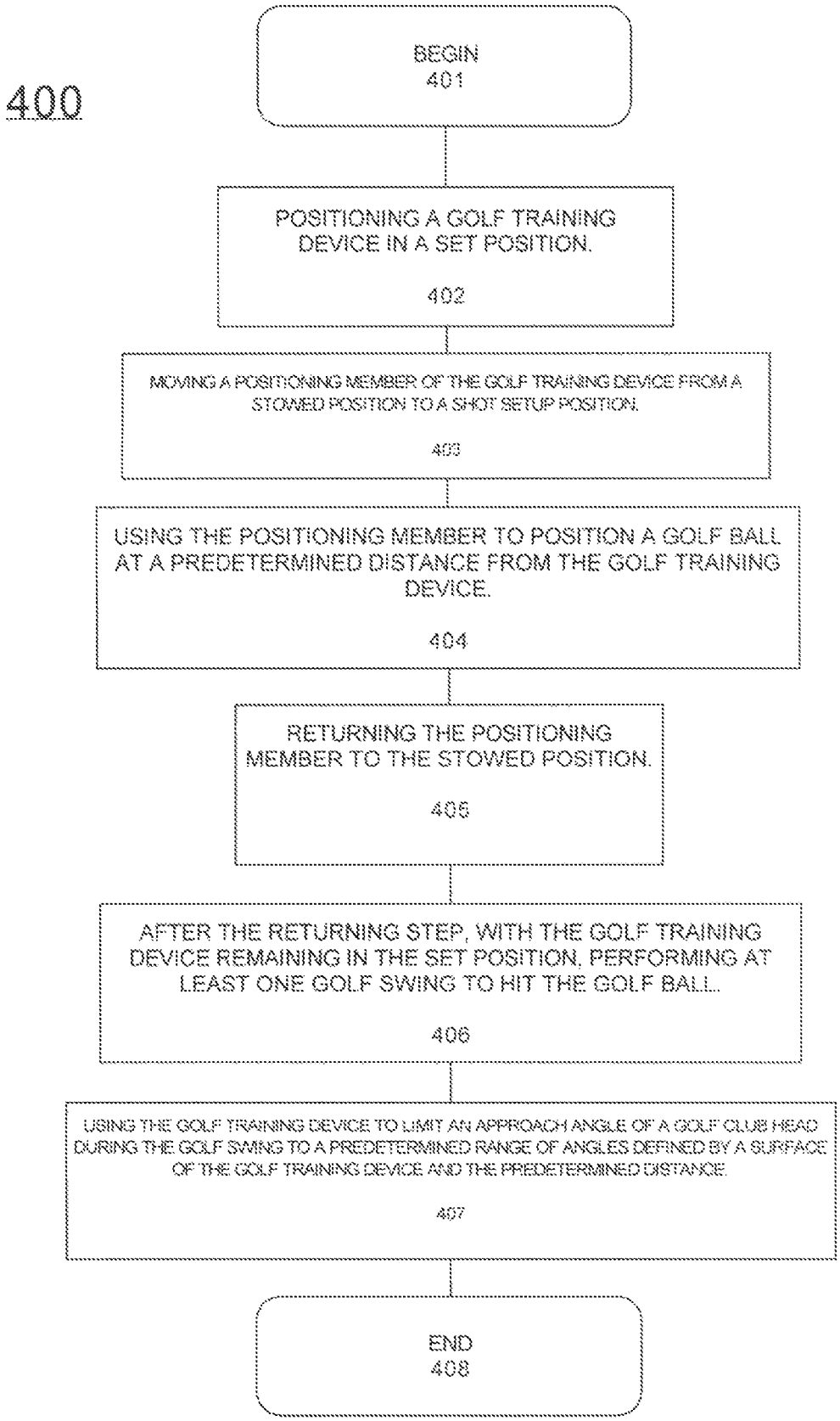
FIG. 8 is a flow diagram of a method for practicing golf shots with the device of FIG. 2.

Referring now to FIG. 8, shown is a flow diagram of a method 400 for practicing golf shots, and for guiding a movement of a golf club during a swing. The method begins with step 401 and continues with step 402.

In step 402, a golf training device is positioned in a set position. Typically, the golf training device is positioned on a portion of a golf course a selected distance from the putting green.

In step 403, the method includes the step of moving a positioning member of the golf training device from a stowed position to a shot setup position. The positioning member can selected to be a first positioning member or a second positioning member corresponding to a pitch shot or chip shot setup position.

In step 404, the method includes the step of using the positioning member to position a golf ball at a predetermined distance from the golf training device. The predetermined distance can be selected to be a first predetermined distance or a second predetermined distance corresponding the pitch shot or chip shot setup positions.

In step 405, the method includes the step of returning the positioning member to the stowed position. A channel is provided on the device for stowing the positioning member in the slowed position.

In step 406, the method includes the step of after the returning step, with the golf training device remaining in the set position, performing at least one golf swing to hit the golf ball.

The method includes the step 407 of using the golf training device to limit an approach angle of a golf club head during the golf swing to a predetermined range of angles defined by the upper surface of the golf training device and the predetermined distance.

The method ends with step 408.

All of the apparatus, methods and algorithms disclosed and claimed herein can be made and executed without undue experimentation in light of the present disclosure. While the invention has been described in terms of preferred embodiments, it will be apparent to those of skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those skilled in the art are deemed to be within the spirit, scope and concept of the invention as defined.

I claim:

1. A golf training device for setting up practice shots, comprising:

a planar base portion including an edge defining an axis;

at least one positioning member movable from a stowed position to a shot setup position, said positioning member including one or more indicia configured for positioning one or more golf balls adjacent to the positioning member a predetermined distance from the axis when moved to the shot setup position; and at least one channel defined on the base portion configured for stowing the positioning member while a golfer positioned relative to the axis strikes the one or more golf balls with a golf club, wherein the axis, the predetermined distance, and a height of the device define a visual guide for the backswing and downswing of the golf club configured for defining an angle of approach of the golf club while the golfer strikes the one or more golf balls.

2. The device of claim 1, wherein said shot setup position includes pitch and chip shot setup positions.

3. The device of claim 1, wherein said positioning member includes a first positioning member and a second positioning member.

4. The device of claim 1, wherein said positioning member includes a first positioning member and the predetermined distance includes a first predetermined distance corresponding to a pitch shot.

5. The device of claim 1, wherein said positioning member includes a second positioning member and the predetermined distance includes a second predetermined distance corresponding to a chip shot.

6. The device of claim 1, wherein said positioning member is u-shaped.

7. The device of claim 6, further including a first planar portion and a second planar portion defining an upper surface of the device.

8. The device of claim 7, wherein free ends of the positioning member are movably attached to the first planar portion by pins.

9. The device of claim 1, wherein said one or more indicia are equally spaced along an edge of the positioning member.

10. The device of claim 1, wherein said one or more indicia are six indicia and said one or more golf balls are six golf balls.

11. A golf training device for setting up one or more golf balls for practicing golf shots, comprising:

a planar base portion including an edge defining an axis, at least a first positioning member movable from a stowed position to a first shot setup position, said first positioning member including one or more indicia configured for positioning one or more golf balls adjacent to the first positioning member a first predetermined distance from the axis when moved to the first shot setup position;

at least a second positioning member movable from a stowed position to a second shot setup position, said second positioning member including one or more indicia configured for positioning one or more golf balls adjacent to the second positioning member a second predetermined distance when moved to the second shot setup position; and a channel defined on the base portion for each of the first and second positioning members configured for stowing the first and second positioning members while a golfer positioned relative to the axis strikes the one or more golf balls.

12. The device of claim 11, wherein said first shot setup position includes a pitch shot setup position.

13. The device of claim 11, wherein said second shot setup position includes a chip shot setup position.

14. The device of claim 11, wherein said first positioning member and the first predetermined distance correspond to a pitch shot.

15. The device of claim 11, wherein said second positioning member and the second predetermined distance correspond to a chip shot.

16. The device of claim 11, wherein said first and second positioning members are u-shaped.

17. The device of claim 16, wherein free ends of the first and second positioning members are movably attached to the first planar portion by pins.

18. The device of claim 11, further including a first planar portion and a second planar portion defining an upper surface of the device.

19. The device of claim 18, wherein the axis, first predetermined distance, and upper surface define a visual guide for the backswing and downswing of the golf club configured for defining an angle of approach of the golf club for a pitch shot while the golfer strikes the one or more golf balls.

20. The device of claim 18, wherein the axis, second predetermined distance, and upper surface define a visual guide for the backswing and downswing of the golf club configured for defining an angle of approach of the golf club for a pitch shot while the golfer strikes the one or more golf balls.

21. The device of claim 11, wherein said one or more indicia are equally spaced along an edge of the first and second positioning members.

22. The device of claim 11, wherein said one or more indicia are six indicia and said one or more golf balls are six golf balls.

* * * * *